United States Patent [19]

Bailey

[11] 3,949,450

[45] Apr. 13, 1976

[54] WIRE BALE TIRE AND METHOD OF MAKING THE SAME

[75] Inventor: Brian Charles Bailey, Birmingham, England

[73] Assignee: F. A. Power Limited, Birmingham, England

[22] Filed: Dec. 19, 1974

[21] Appl. No.: 534,370

[52] U.S. Cl. ..... 24/27; 72/366; 140/73

[51] Int. Cl.[2]... B21B 1/00; B21F 1/06; B65D 63/10

[58] Field of Search.... 24/16 R, 27, 28, 29, 150 FP; 72/366; 140/73

[56] References Cited

UNITED STATES PATENTS

| | | | |
|---|---|---|---|
| 706,994 | 8/1902 | Nighman | 72/366 |
| 1,453,456 | 5/1923 | Gerrard et al. | 140/73 |
| 1,980,503 | 11/1934 | Rowe | 24/27 X |
| 3,195,583 | 7/1965 | Jones | 140/73 X |
| 3,444,597 | 5/1969 | Bone | 24/150 FP |

FOREIGN PATENTS OR APPLICATIONS

| | | | |
|---|---|---|---|
| 724,950 | 2/1932 | France | 24/27 |
| 426,556 | 4/1935 | United Kingdom | 24/27 |
| 899,364 | 6/1962 | United Kingdom | 24/16 R |
| 969,412 | 9/1964 | United Kingdom | 72/366 |

*Primary Examiner*—Donald A. Griffin
*Attorney, Agent, or Firm*—John Harrow Leonard

[57] ABSTRACT

A length of wire of uniform composition throughout has end portions of circular cross section bent into the form of mutually interengageable loops with free ends. The loops can be interengaged and then drawn into a knot by endwise tension applied to the wire. The portion of the wire intermediate the end portions is of uniform oval cross section of such less area than the circular cross section of the end portion that, when the wire is subjected to a direct tensile pull, its load capacity approaches more nearly the load capacity of the knot than in prior wire bale ties. The longest cross sectional dimension of the intermediate portion of the wire is juxtaposed flatwise against the bale in the installed condition of the tie.

13 Claims, 12 Drawing Figures

WIRE BALE TIRE AND METHOD OF MAKING THE SAME

BACKGROUND OF INVENTION

1. Field of Invention

This invention relates to wire bale ties for use in binding compressed material to form a bale.

2. Description of Prior Art

As more fully set forth in U.S. Pat. No. 3,477,363 of C. D. Trumbo, issued Nov. 11, 1969, cotton is baled by holding it in compressed condition in a conventional baling press and, while it is so held, passing around the compressed mass a number of bale tie wires of a type having interengageable loops at opposite ends. The loops of each tie wire are then brought into alignment with each other transversely of the wire axis and are interengaged by movement of the end portions of the wire transversely of the wire axis. The loops are of such a nature that when the baling pressure is released, the expansion of the cotton mass applies tension to the bale tie wires endwise thereof sufficiently to pull the interengaged loops of each tie wire into a tight knot.

Experience has demonstrated that the fracture or breakage of such bale tie wires most generally occurs in the knotted portion. This failure apparently is due to the weakening of the wire and resultant reduction in its load capacity due to bending it into the loops and pulling the loops into knots. Thus the load capacity of the knot is less than the load capacity of the unknotted portion of the wire. The term load capacity, as applied herein to the knot and to the wire, means the maximum load which can be withstood without breakage when the load is applied as a direct tensile pull on the wire. Necessarily, for forming such loops, and eventually knots, as a result of the expansion of the material after release of the press, certain ductility is required in the wire itself. A compromise is made between the optimum ductility of the wire, required for readily forming the loop and knot and for bending about the bale, and the ability of the knot to withstand the tensile pull on the wire resulting from the expansion of the baled material upon release by the press. Accordingly, in order to assure a knot of the required load capacity with a wire of sufficient bendability, the wire used is of larger cross section throughout its length than it needs to be merely to withstand any direct tensile stresses imposed on the portion of the wire between the knotted ends by the expansion of the baled material.

Again, while ready bendability of the wire about the bale is desirable, it is necessary also that the wire have adequate load capacity to resist elongation under the forces continuously imposed by the baled material.

Heretofore attempts were made to overcome the weaknesses in prior bale ties by using a wire of given physical properties for the midportion of a wire tie and a wire of different physical properties, such as wire annealed for higher ductility and butt welded to the ends of the wire forming the intermediate portion to provide the loop forming portions. For example, in U.S. patent to Rowe, U.S. Pat. No. 1,980,503, in order to obtain the ductility of the end portions without the necessity of annealing the entire wire only the end portions were annealed. In a modification an annealed length of wire was butt welded to the ends of the latter for forming the loops. However, this is very expensive and seems to have the disadvantage of a very abrupt change from one cross section to the other with consequent concentration of stresses and weaknesses.

Another attempted solution was to enclose the end portions of the wire in sleeves to increase the thickness and size of the cross section, as described in the German patent No. 1,015,740, of Sept. 12, 1957.

Recently various laws have been passed limiting the total weight of baling material that can be used in relation to the weight of the bale itself. Concurrently, there has been a considerable increase in the price of wire.

Because of the factors hereinbefore set forth, conventional wire ties have a number of disadvantages. Due to the large cross sections of their intermediate portions, they are difficult to bend as readily as desired about, and in close conformance to the periphery of, the compressed material; and, therefore, they do not lie snugly against the material while it is held compacted by the press. Consequently, longer wire ties are necessary than would be the case did wire ties embrace the material tightly before its release by the press. They employ the inherent characteristics of the metal inefficiently and so require a further excess of metal, thereby increasing the cost. Due to the round cross section, they tend to cut the material in the outer strata of the bale.

The optimum bale tie is one which (a) can be bent readily into firm contact throughout its length with the material while the material is held compressed by the press, (b) presents a relatively flat surface against the outer surface of the baled material so as not to damage or cut into the baled material, and (c) employs the metal with better mechanical efficiency so that the load capacity of the resultant knot and that of the portion of the wire tie between the knotted ends, insofar as concerns resistance to the tensional forces applied on the wire by the baled material, more nearly approach each other than in prior ties, and (d) requires much less metal for a given bale.

SUMMARY OF THE INVENTION

The bale tie wire of the present invention approaches much more closely than prior bale tie wires the optimum efficiency in the use of the metal of the wire. The tie wire can be formed readily and this efficiency of the tie obtained by the method of cold rolling selected portions of a uniform length of wire of preselected physical properties.

Various other and specific advantages of the wire tie will become apparent from the following description wherein reference is made to the drawings.

DESCRIPTION OF THE PREFERRED EMBODIMENT

Figure 1:
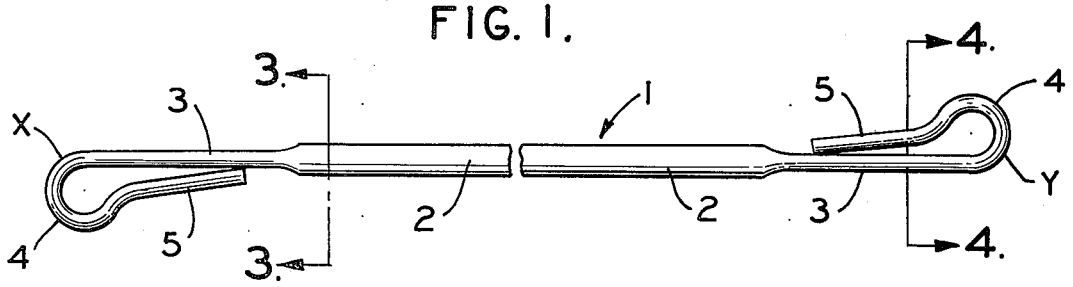
FIG. 1 is a top plan view of a wire bale tie embodying the principles of the present invention.
Figure 2:
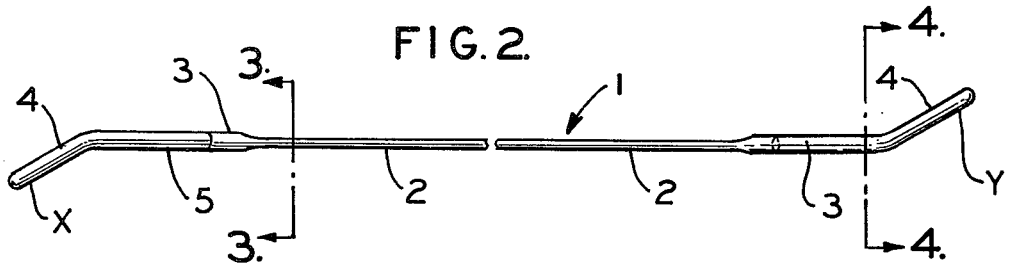
FIG. 2 is a side elevation of the tie illustrated in FIG. 1.
Figure 3:
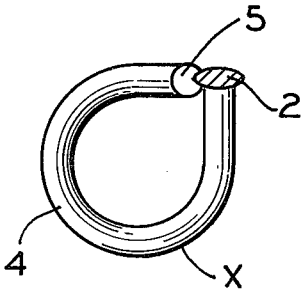
FIG. 3 is an enlarged vertical cross sectional view of a portion of the wire tie and is taken on the line 3—3 in FIGS. 1 and 2.
Figure 4:
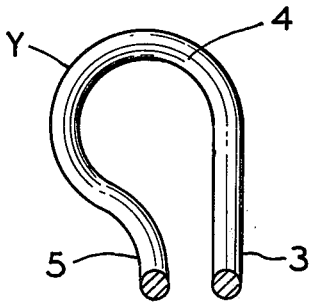
FIG. 4 is an enlarged vertical cross sectional view of another portion of the tie and is taken on the line 4—4 in FIGS. 1 and 2.

Referring to the drawings, the bale tie, indicated generally at 1, is in the form of a single length of wire having an intermediate portion 2 and end portions 3. Such ties are several feet in length, but each end portion is only a few inches in length. The end portions 3 are bent into loops 4 which are arranged at diametrically opposite sides of the wire and lie in parallel planes, respectively, which are oblique to the wire axis. Each loop 4 has at one end a free end portion 5 and at the other end a straight portion which connects the other end of the loop to the portion of the wire intermediate the end portions. The free end portion 5 and straight portion 3 of each loop, in the straight condition of the tie, lie generally in a common plane which includes the wire axis.

Figure 5:
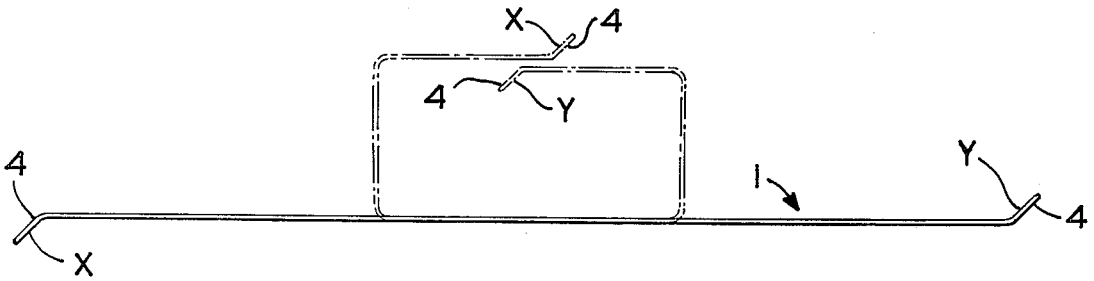
FIG. 5 is a diagrammatic illustration of the bale showing the positioning of the looped ends of the tie preparatory to and after wrapping it about a bale prior to knotting.

As illustrated in FIG. 5, the loop 4 at the left hand end of the wire, indicated at X, slopes downwardly away from the wire axis and the loop 4 at the right hand end of the wire, indicated at Y, slopes upwardly away from the wire axis. When the wire is bent about a bale prior to engaging the loops, it assumes the position indicated by the dot-dash lines in FIG. 5. In this position, the loop 4 at the left hand end of the wire slopes upwardly from the wire axis and the loop 4 at the right hand end slopes downwardly from the wire axis, so that the loop at X is above the loop at Y and when moved downwardly will assume the initially engaged position illustrated in FIGS. 6 and 7.

Figure 6:
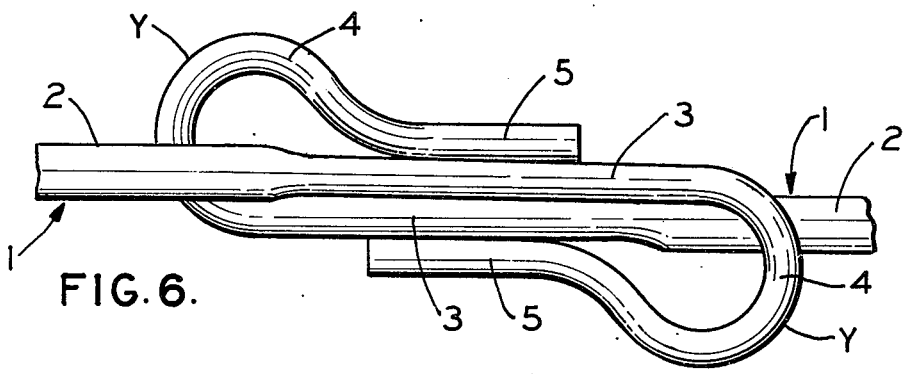
FIG. 6 is an enlarged fragmentary top plan view of the opposite looped ends of a tie showing the loops being initially engaged after the tie has been passed around the bale.
Figure 7:
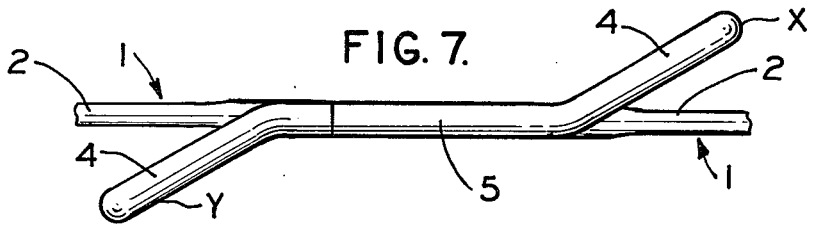
FIG. 7 is an enlarged front elevation of the structure illustrated in FIG. 4.
Figure 8:
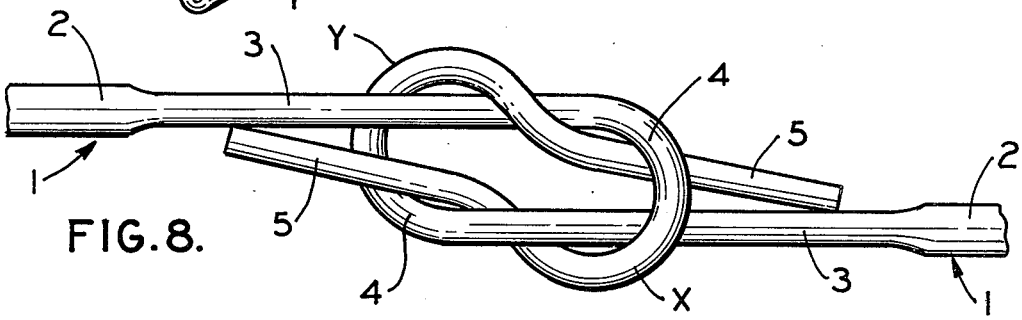
FIG. 8 is an enlarged fragmentary top plan view, similar to FIG. 6, showing the loops of the opposite ends of the tie initially interengaged preparatory to being drawn into a knot.
Figure 9:
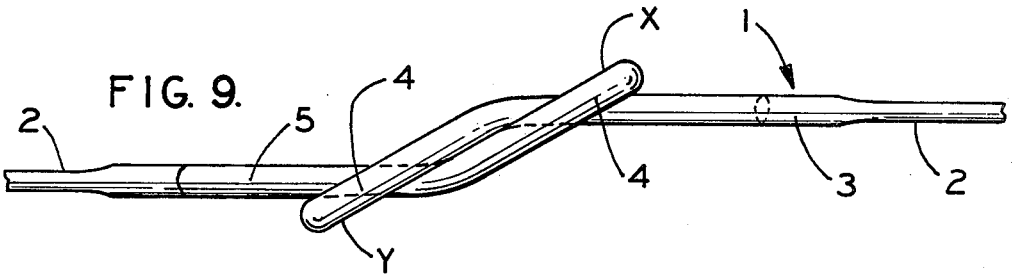
FIG. 9 is an enlarged front elevation of the structure illustrated in FIG. 8.

The tie is placed around a mass of material, while the material is held in compressed condition by a baling press, and the opposite looped ends of the wire tie, are moved normal to their planes or transversely of the loops so as to interengage the two loops initially, as illustrated in FIGS. 6 and 7. Upon releasing the press, the baled material expands exerting endwise tension on the wire sufficient to pull the interengaged loops into the initially knotted position illustrated in FIGS. 8 and 9. As the full tensioning force of the expanding bale becomes effective on the tie due to complete release of the baling press, the loops are drawn more tightly into the final knot.

As mentioned, the bending of the loops has a tendency to weaken the wire to some extent and change its qualities and drawing it tightly into the knot further reduces its strength. When breakage occurs it is usually in the loop or knotted portion of the wire. The end portions adjacent the loop seldom break as they are of much greater strength than the knotted wire. Accordingly, if the wire is made the full diameter throughout its length, the intermediate portion 2 of the wire has a load capacity much in excess of that of the knot. Thus there is an imbalance in the load capacity of knot and the load capacity of the intermediate portion of the wire and consequently an inefficient disposition and use of the metal.

In accordance with the present invention a more efficient distribution of the material is obtained by reducing this intermediate portion 2 of the wire to a smaller cross section having a resultant load capacity more nearly, and optimally the same as, that of the knot.

Preferably this reduction is effected by cold rolling a long length of the selected wire while confining it peripherally at the rolling throat, as hereinafter described. The rolling step not only reduces the cross section for more nearly balanced load capacity relative to that of the knot, but also produces a cross section of lenticular or oval shape which is much wider relative to its thickness than in the original wire and, therefore, can be bent flatwise more readily about and into snug conformance with the bale, especially about the corners of the bale.

The rolling is effected so that the flattening or widening is generally radially outwardly of the wire axis in the general plane of the free end portions 5 and the straight portions 3 which connect the loops to the intermediate portion 2. For example, if the structure, as positioned in FIG. 1, is passed under a bale and the ends swung upwardly to make the tie, as illustrated in FIG. 5, the wider side of the intermediate portion 2 is juxtaposed against the bale material and the loops are positioned so that, flatwise, they face the bale surface.

Figure 12:
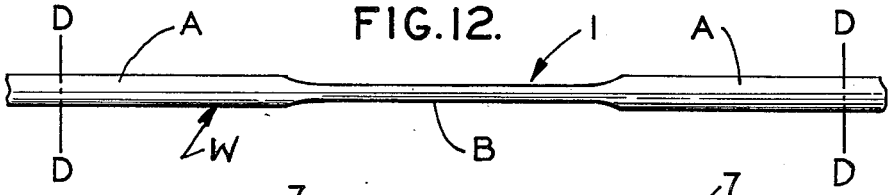
FIG. 12 is a side elevation of a length of wire illustrating a step of the method.
Figure 10:
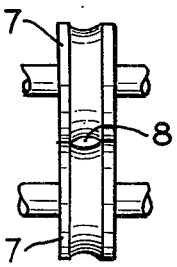
FIG. 10 is a diagrammatic illustration of an apparatus used in the method of making the wire bale tie of the present invention.
Figure 11:
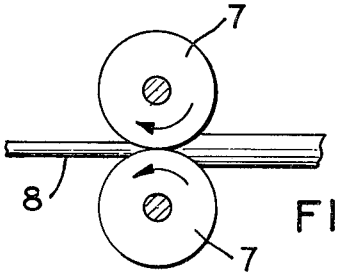
FIG. 11 is a side elevation of the structure illustrated in FIG. 10.

The cold rolling may be done conveniently by passing the wire to be used in the tie endwise through a set of grooved rolls 7 so that the periphery of the wire at the throat 8 of the rolls is fully confined peripherally of the wire. This eliminates any flash or edges which might tend to interfere with the bale or endanger the hands of the workman or those handling the ties before or after installation, and assures that the excess metal is drawn and used for elongation of the tie. This type of rolling lends itself to quantity production of the wire in that, as illustrated in FIG. 12, a length of wire W, can be fed from a reel, straightened, and passed continuously between the rolls 7. The rolls 7 are intermittently separated and closed during travel of the wire so that the wire is unchanged in shape and condition at portions A, which are to provide the end portions 3 of the ties, and reduced at the intermediate portions B which become the intermediate portions 2 of the ties. Further, this method can permit a more gradual merging of the reduced portions with the end portions, thus eliminating abrupt shoulders or changes in diameter at the ends of the portions B and consequently avoiding the concentrated stresses usually resulting at abrupt shoulders. The length of each portion A is only a few inches, while the length of each portion B is several feet. The rolled wire is cut to lengths at the midportions of the unrolled portions A, as indicated by the lines D—D in FIG. 12, so that each length provides a blank tie with a reduced intermediate portion 2 and end portions 3 of equal length.

Necessarily, the type of material to be baled, the size of the bale, and other extraneous factors vary to such a degree that it is difficult to set forth a specific formula as to the stock wire used or an exact equation as to the reduction of the intermediate portion. First, the forces to be imposed vary with the type and size of bale, the type and resiliency of the material to be baled, and the degree of compression of the material by the press. Secondly, there are variations in the quality of any given type of wire supplied commercially. Again, there may be a desire on the part of the user for a given size loop fitted more to his convenience in installation and in the tightness of the baling which is reflected in the amount of tensile forces applied to the installed bale tie wire. Thirdly, the physical properties of the wire loop are affected or changed as a result of bending it into a loop, bending the loop out of its normal plane, and drawing the loop into a knot. The physical properties of the intermediate portion are changed due to the rolling and elongating operation. Generally rolling reduces the load capacity and ductility, the wire tending toward brittleness if reduced unduly by rolling.

Since there are so many variables involved, the guiding principles, rather than numerous specific examples, are believed to be more effective for enabling others to practice the present invention.

The load capacity of the intermediate portion under direct tension endwise of the wire should approach as closely as practical that of the knot, having in mind other parameters and that the knot, formed by pulling the interengaged loops into knotted condition, is the weakest portion of the tie. Since usually bale tie wires are sold in large batches for baling many bales of like material and under like pressures, the most practical size and type of wire to use and the reduction in cross section permissible can be determined simply by ordinary pull tests, or the installation on a typical bale of a few preliminary runs of ties rolled to slightly different cross sections. If a disproportionate number of ties fails in the loops, then a further reduction in the cross section of the intermediate portions is permissible. If, on the contrary, they fail in the intermediate portion, a lesser reduction of the intermediate portion is indicated. Thus the method includes a step of selecting initially a wire of given strength and ductility for looping, knotting and holding the bale, and then reducing the cross section of successive long portions B in the manner described while leaving the intermediate portions A in the original shape and condition, without changing their physical characteristics, allowance being made for the reduced load capacity of the knot as compared to the unknotted wire. Thus there is little problem involved in determining the amount of reduction in any given instance. A few simple initial pull tests of a wire tie with reduced cross section is the simplest guide for finally selecting the original wire stock to be used and the degree of reduction permissible for a given set of extraneous conditions. The length of wire is chosen sufficiently shorter than what would normally be used if the tie were to be of the same diameter throughout, because the step of reducing the cross section by cold rolling while the wire is confined about its periphery draws and increases the length of wire in a fixed relation to the degree of reduction of cross section.

The stock wire from which the present bale tie for a conventional cotton bale is to be formed is spring quality steel. The end portions of the present wire tie are the same as those of the wire tie disclosed in the above cited U.S. Pat. No. 3,477,363; for example, wire of circular cross section. It may have a diameter of 0.143 inches, for example. It has the necessary ductility for forming the loops, but a load capacity under a direct tensile pull considerably greater than that of the resulting knot. In the example, the knot has a load capacity of only about 62 percent of the load capacity of the normal wire stock, and hence the knotted portion would break while the remainder of the wire was far below the breaking point. This original spring quality steel wire stock is cold rolled between the portions A to oval, substantially elliptical, cross section with a major diameter of 0.169 inches and a minor diameter of 0.104 inches. This reduces the load capacity of the portion B to from 75 to 80 percent of the original load capacity of the unrolled wire.

The portion A which is to form the loops is unchanged so that the knot will retain a load capacity of about 62 percent of that of the intermediate portion of the original wire. Otherwise stated, the portion B originally is about 1.6 times as strong as the knot. As a result of the reduction step, the load capacity of the portion B becomes about 75 percent of the load capacity of the original wire so that it is then only about 1.2 times as strong as the knot will be. The reduction in the load capacity of the portion B preferably is in the range of from about 12 to 25 percent, with proportional elongation, depending upon the physical and metallurgical properties of the wire stock selected, in which case the load capacity of the portion B may range from about 1.4 times to about 1.2 times that of the knot. These reductions effect a saving in metal without any sacrifice in the overall load or pull the wire tie can withstand without breakage, and with the advantages herein set forth. One could further reduce the cross section of the portion B by the cold rolling step, optimally to a degree such that the load capacity of the portion B is equal to that of the knot, but certain variable limiting related practical factors must be taken into consideration.

First, the wire becomes less ductile as its cross section is reduced by such cold rolling, and if the reduction is carried far enough, the wire approaches brittleness to a degree such that it may fracture when pulled tightly about a bale, particularly at the corners of the bale which impose relatively short radius bends on the wire. Allowance must be made for this factor in the original choice of wire stock selected, in the degree of reduction, in the cost of the stock, in the ductility, in the increased danger of failure of the ties as ductility is reduced, offsetting costs of labor and replacement ties in case of failures, and variations in the quality of any given commercial wire stock. With spring quality steel wire, the rolling which reduces the load capacity of the portion B so that it is only about 1.2 times that of the knot, is very satisfactory and allows a factor of safety for variations in these factors.

The elongation obtained is such that in a tie of the present invention, having the usual length of cotton bale ties customarily used, which is 10 feet, 6 inches, the saving in metal, as compared to the conventional tie, is about 20 percent. Considering the price of metal and the number of ties required for each bale, and the legal limitations on the permissible weight of ties relative to the weight of the baled material, the saving and advantages are very substantial. Part of this saving is due to the elongation of the wire stock and part to the fact that, because of its flatter cross section, the tie can be wrapped more tightly about, and conformed to, the compressed material before the release by the press, so that a shorter tie can be used for a given size bale.

It is apparent from the foregoing that the present wire bale tie and the method of manufacturing result in a great saving in the length of original stock wire required, in the total amount of metal required per bale, in a reduced intermediate portion having an actual load capacity under a direct pull on the wire more nearly approximating that of the knotted ends of the wire tie, and, due to the flatness of its cross section, in greater bendability and ability to be drawn into better juxtaposition with the periphery of the baled material, and particularly the corners of the bale, prior to release of the compressed material by the press. This latter feature in itself makes possible the use of a shorter wire bale tie for a given size bale, as compared to prior wire bale ties which are so stiff that they tend to bow and not to lie snugly against the baled material prior to its release by the press. The present tie results also in a reduction in the shipping weight of the bale itself with a consequent saving in shipping and handling charges per bale.

Having thus described my invention, I claim:

1. A method of making a wire tie for binding baled material, which tie comprises a length of wire of which each end portion is bent back upon itself to form a loop with a free leg which extends substantially in the direction of the portion of the wire adjacent the loop so that the two loops at opposite ends can be interengaged by movement transversely of the length of wire and formed, after they are interengaged, into a knot of predetermined strength by pulling said loops endwise of the wire in opposite directions relative to each other under predetermined tensioning forces applied to the loops by the wire endwise of the wire, said method comprising:

work forming a starting unitary length of wire of less than the length required in the finished tie while confining it about its periphery radially of its cross section so as to reduce the cross section of an intermediate portion thereof, which intermediate portion constitutes most of the length of the wire and which extends from adjacent one end portion to adjacent the opposite end portion, to uniform smaller cross section than the cross section of said end portions of the wire, and concurrently to elongate the said intermediate portion to increase the length of the wire to bring the overall length up to the length required in the finished tie while leaving the end portions of sufficient length for said loops, respectively, and to reduce the load capacity of the original intermediate portion relative to that of said end portions, respectively, so that the load capacity of the reduced intermediate portion will be greater than, but will more closely approach, that of the knot when formed than did the load capacity of said intermediate portion before said reduction in cross section; and bending the end portions into said loops.

2. The method according to claim 1 wherein the starting length of wire selected is of uniform cross section throughout its length and of a cross section required in the end portions, which has the degree of bendability required for forming said loops and for the drawing of the formed loops into a knot, and which can be both work formed as to shape throughout said intermediate portion by cold rolling while confined radially and concurrently elongated thereby to provide the proper length of tie while said end portions are retained in the condition in which they were prior to said work forming operation.

3. The method according to claim 1 wherein said rolling step effects reduction of the cross section of the intermediate portion and reduces the load capacity of the intermediate portion to a degree such as to impart to the intermediate portion a total resistance to breakage by tensile forces applied endwise of the wire approximating the resistance to breakage of the loops by said tensile forces after the loops have been drawn into knotted condition by said tensile forces.

4. The method according to claim 1 wherein the rolling imparts to said intermediate portion a cross sectional shape which is uniform throughout the length of the intermediate portion and ranges in shape from oval to lenticular.

5. The method according to claim 1 wherein the rolling imparts to said intermediate portion a resistance to breakage by tension forces applied endwise of the intermediate portion which resistance has a predetermined relation to the resistance to breakage of the knot into which the loops can be drawn by said tension forces.

6. The method according to claim 5 wherein said resistance to breakage of the intermediate portions is from about 1.2 to 1.4 times that of the knot.

7. A wire tie comprising a length of wire of uniform composition throughout and of a ductility such that it can be bent about a short radius without fracture, said wire having each of its opposite end portions in the form of a loop with a free leg at one end of the loop extending endwise generally alongside and in the general direction of a straight portion of the wire at the other end of the loop, and said wire having an intermediate portion extending from one of said straight portions to the other and being long relative to said end portions, said loops being arranged to be loosely interengageable by movement of the loops toward each other transversely of their free end portions and to be drawable into a knot by pulling the end portions in opposite directions by predetermined tension forces applied by, and endwise of, the intermediate portion to the end portions adjacent the loops, respectively;

characterized in that said intermediate portion has a smaller cross section that each of said end portions and has different physical characteristics than the end portions, and the load capacity of the intermediate portion when the tie is subjected to direct tensile pull is greater than that of the resulting knot, but more closely approaches that of the knot than do the portions of the tie between the intermediate portion and the loops.

8. A wire tie according to claim 7 wherein the load capacity of said intermediate portion is from about 1.2 to 1.4 times that of the knot.

9. A wire tie according to claim 7 wherein the cross section of said intermediate portion has a curvilinear periphery which is uniform throughout its length and is within a range of shapes from oval to lenticular.

10. A wire tie according to claim 7 wherein said intermediate portion is harder and denser than the end portions, respectively.

11. A wire tie according to claim 7 wherein the wire is steel and said intermediate portion has physical properties and increased length resulting from cold rolling of a portion of the original wire while confining the periphery of that portion radially.

12. A wire tie according to claim 7 wherein the juncture between each end portion and the intermediate portion is of gradually decreasing cross section from the end portion to the intermediate portion.

13. A wire tie according to claim 7 wherein the free leg and straight portion at each loop are of uniform circular cross section, and said intermediate portion of the wire has a cross section of greater length than width, and, when the tie is in straight condition, the free legs and adjacent straight portions at the loops have their axes generally in a common plane, and the major dimension of said cross section of the intermediate portion lies substantially in said common plane.

* * * * *

UNITED STATES PATENT OFFICE

CERTIFICATE OF CORRECTION

PATENT NO. : 3,949,450

DATED : April 13, 1976

INVENTOR(S) : Brian Charles Bailey

It is certified that error appears in the above-identified patent and that said Letters Patent are hereby corrected as shown below:

Page 1, in the Title, for "TIRE" read --TIE--.

Col 8, line 46, for "that" read --than--.

Signed and Sealed this

Sixth Day of July 1976

[SEAL]

*Attest:*

RUTH C. MASON
*Attesting Officer*

C. MARSHALL DANN
*Commissioner of Patents and Trademarks*